United States Patent [19]

Baugh et al.

[11] 4,406,324

[45] Sep. 27, 1983

[54] BOTTOM LOCK PIPE SEAL ASSEMBLY

[75] Inventors: John L. Baugh, Huntsville; James W. Montgomery, Houston, both of Tex.

[73] Assignee: Hughes Tool Company, Houston, Tex.

[21] Appl. No.: 267,726

[22] Filed: May 28, 1981

[51] Int. Cl.[3] ..... E21B 23/00

[52] U.S. Cl. ..... 166/125; 166/140; 166/182

[58] Field of Search ..... 166/125, 382, 138, 140, 166/141, 118, 119, 181, 182

[56] References Cited

U.S. PATENT DOCUMENTS

| | | | |
|---|---|---|---|
| 2,862,560 | 12/1958 | Bostock et al. | 166/125 |
| 2,894,586 | 7/1959 | Schramm et al. | 166/125 |
| 2,976,931 | 3/1961 | Daffin | 166/125 |
| 3,100,532 | 8/1963 | Tamplen | 166/125 |
| 3,139,141 | 6/1964 | Fredd et al. | 166/125 |
| 3,208,531 | 9/1965 | Tamplen | 166/125 |
| 3,342,268 | 9/1967 | Brown | 166/124 |
| 3,910,349 | 10/1975 | Brown et al. | 166/153 |
| 3,920,075 | 11/1975 | Braddick et al. | 166/290 |
| 3,934,652 | 1/1976 | Cochran | 166/285 |
| 4,018,272 | 4/1977 | Brown et al. | 166/119 |
| 4,161,984 | 7/1979 | Watkins | 166/382 |

FOREIGN PATENT DOCUMENTS

| | | | |
|---|---|---|---|
| 887150 | 1/1962 | United Kingdom | 166/125 |

*Primary Examiner*—Ernest R. Purser
*Assistant Examiner*—Thuy M. Bui
*Attorney, Agent, or Firm*—Robert A. Felsman; Charles D. Gunter, Jr.

[57] ABSTRACT

A seal assembly is disclosed including first and second annular members mutually movable longitudinally to effect a first configuration in which the seal assembly is releasably anchored to a cylindrical body circumscribed by the seal assembly, and a second configuration in which the seal assembly is releasably anchored to a surrounding conduit. Sealing members are carried by the seal assembly to engage the enclosed cylindrical body as well as the circumscribing conduit. Operation of the seal assembly for movement between the first and second configurations is accomplished by manipulation of the cylindrical body which, with the seal assembly anchored to the conduit, is permitted limited longitudinal movement relative to the conduit and seal assembly while maintaining sealing engagement with the seal assembly. A disclosed embodiment includes a well seal assembly, or packer, for sealing a pipe string to a well conduit.

6 Claims, 6 Drawing Figures

BOTTOM LOCK PIPE SEAL ASSEMBLY

BACKGROUND OF THE INVENTION

1. Field of the Invention

The present invention pertains to techniques for sealing cylindrical bodies to circumscribing conduits. More particularly, the present invention relates to seal assemblies for positioning within, and anchoring to, the interiors of conduits, and finds particular application to apparatus and methods for sealing pipe strings to conduits within wells.

2. Description of Prior Art

Sealing apparatus of various kinds are used in several well working operations, and in the production of a well. For example, in downhole cementing procedures, seal assemblies are used to control the placement of cement and the maintenance of pressure to accomplish cementing operations. Seal assemblies in the form of packers are known for isolating formations for treatment, or for isolating segments of liner or casing for squeeze cementing, for example. Packers are routinely used for sealing production strings to liner or casing to define flow paths from producing formations to the surface. Several packers may be utilized to isolate various formations in a multi-zone producing well. Polished bore receptacles are used in conjunction with annular seal members to provide sliding seals.

Particularly in the case of packers, the seal assembly is usually positioned within a well by means of a pipe string, and then set in sealing and anchoring engagement with the surrounding conduit. The pipe string may be released from anchoring engagement with the packer, and be movable in the well without disturbing the setting of the packer in engagement with the well conduit. The setting operation usually involves the movement of multiple components of the packer to expand one or more resilient seal members, and to wedge anchoring slips against the surrounding well conduit. These operations are controlled from the surface, and may be effected either by manipulation of the pipe string used to carry the packer into the well, or by application of hydraulic pressure through the pipe string to the packer. Retrievable packers are known, and may be released from the well conduit by one or more operations carried out with the pipe string.

Inflatable packers are known for use in unlined wells. In the case of production packers, the seal assemblies used to isolate formations and define flow paths to the surface are set within well casing or liner, which is usually made up to include a sequence of tubular members threaded together or joined by collars.

SUMMARY OF THE INVENTION

Apparatus according to the present includes first and second members mutually movable generally longitudinally between a first configuration, in which the members are releasably latched to a cylindrical body, and a second configuration in which the members are released from latching configuration with the cylindrical body and are releasably latched to a conduit or tubular body generally circumscribing the members and the cylindrical body. The first and second members include a first latch mechanism by which the members are latched to the cylindrical body in the first configuration. A second latch mechanism as part of the first and second members latches the members to the conduit in the second configuration. The first and second members may be positioned within the conduit by means of the cylindrical body, to which the members are latched in the first configuration. Manipulation of the cylindrical body may then be used to operate the first and second members to move them to the second configuration, in anchoring engagement with the conduit and released from anchoring engagement with the cylinder. Further movement of the cylinder may operate the first and second members to latch the members to the cylinder, and release them from latching engagement with the conduit. A detent included with the conduit may engage and hold the first member against axial movement to permit the second member to be moved longitudinally relative to the first member by means of longitudinal movement of the cylinder relative to the conduit to move the members from the first configuration to the second configuration.

A seal mechanism is carried by one or both of the first and second members to sealingly engage an exterior, annular seating surface included in the cylindrical body. The sealing mechanism also sealingly engages an interior, annular seating surface included in the conduit, when the first and second members are releasably latched to the conduit. In the latter case, the cylindrical member may be moved longitudinally relative to both the conduit and the first and second members latched and sealed thereto, while maintaining the sealing engagement between the cylindrical body seating surface and the sealing mechanism.

Each of the first and second latching mechanisms may include a plurality of latching dogs radially movable between latching configurations with the respective cylindrical or conduit body, and release configurations. First and second surfaces cooperate with the first and second latching mechanism dogs, respectively, to maintain the dogs in latching configuration, radially contracted in the case of the first latching mechanism, and radially extended in the case of the second latching mechanism. Profiles are provided in the exterior surface of the cylindrical member and the interior surface of the conduit to receive the first and second latching mechanism dogs, respectively.

A third latching mechnism is included in the first and second members to releasably and selectively maintain the members in the first and second configurations. The third mechanism may include a plurality of latching dogs as part of one of the first and second members, and a pair of profiles as part of the other of the two members. The latching dogs are resiliently mounted to be engaged in one of the profiles in the first configuration of the first and second members, and to be engaged in the other of the two profiles in the second configuration. A frangible mechanism such as one or more shear screws or pins may connect the first and second members in the first configuration to preserve that configuration until the members are selectively moved to the second configuration. With the first and second members in the second configuration, a stop mechanism included in the members prevents further mutual longitudinal movement between the members beyond the second configuration.

The second body may include a collet assembly, wherein the first latching mechanism dogs are mounted on the ends of collet fingers for radial movement. The third latching mechanism dogs may be carried on a plurality of collet ribs for radial movement. The second latching mechanism dogs may be mounted for radial movement in apertures in the first member.

In an embodiment described and illustrated, the present invention includes a seal assembly releasably latchable to a pipe string for positioning and setting within a well conduit. A polished annular seating surface carried by the pipe string may be of any length desired to accommodate limited movement of the pipe string with the seal assembly anchored to the well conduit while maintaining sealing engagement between the seal assembly and the pipe string. Such pipe string movement may be employed in various procedures in operating on the well, or may result from thermal expansion of the pipe string, for example. Longitudinal movement of the pipe string relative to the seal assembly latched to the well conduit may latch the seal assembly to the pipe string and release the seal assembly from anchoring to the well conduit so that the seal assembly may be maneuvered relative to the well conduit, and retrieved from the well with the pipe string.

In a method of the invention, a cylindrical body is sealed to a conduit by use of an annular seal assembly circumscribing the cylindrical body in sealing and releasable anchoring engagement. The cylindrical body is maneuvered within the conduit to engage the seal assembly with a stop fixed relative to the conduit, and to sealingly engage the seal assembly with the conduit. Movement of the cylindrical member longitudinally relative to the conduit releases the seal assembly from anchoring engagement with the cylinder and releasably anchors the seal assembly to the conduit. A method of sealing a pipe string in a well conduit is disclosed, in which a seal assembly is sealed and releasably anchored to the pipe string. The pipe string is lowered into the well conduit to a location where the seal assembly engages a stop provided with the conduit, and sealingly engages the conduit. Further lowering of the pipe string relative to the well conduit operates the seal assembly to release the seal assembly from anchoring with the pipe string and to anchor the seal assembly to the conduit. The seal between the pipe string and the conduit is maintained though the pipe string may be moved longitudinally relative to the conduit and seal assembly. The seal assembly may be operated by raising of the pipe string to anchor the seal assembly to the pipe string and to release the seal assembly from anchoring engagement with the well conduit, thereby permitting the seal assembly to be retrieved from the well conduit with the pipe string.

The present invention provides a retrievable well packer including a first latch mechanism for releasably latching the packer to a pipe string whereby the packer may be manipulated within a well conduit, and a second latch mechanism for releasably anchoring the packer to the conduit. The operations of the first and second latch mechanisms are interconnected so that when one of the latch mechanisms is in anchoring configuration the other latch mechanism is in release configuration, and at all times one or the other of the latch mechanisms is in anchoring configuration. A detent mechanism maintains the packer in either the first or the second configuration in which the first or second, respectively, latch mechanism is in anchoring configuration. The packer carries sealing apparatus for sealingly engaging an exterior seating surface of the pipe string and for sealingly engaging an interior seating surface of the conduit. A second detent mechanism limits longitudinal movement of the packer along the well conduit whereby the packer may be positioned within the conduit to effect operation of the second detent mechanism by longitudinal movement of the pipe string to anchor the packer to the well conduit in the second configuration. The pipe string is permitted at least limited longitudinal movement with the packer anchored to the conduit and sealing the conduit to the pipe string. The packer may be released from anchoring engagement with the conduit and reanchored to the pipe string by longitudinal movement of the pipe string.

A well packer according to the present invention may be anchored to a well conduit utilizing a profile provided in the conduit for receiving latching dogs. With the packer disengaged from anchoring with the pipe string used to position and operate the packer, the pipe string may be moved at least a limited longitudinal distance relative to the packer and conduit while maintaining the seal provided by the packer between the pipe string and the conduit.

DESCRIPTION OF PREFERRED EMBODIMENTS

Figure 1A:
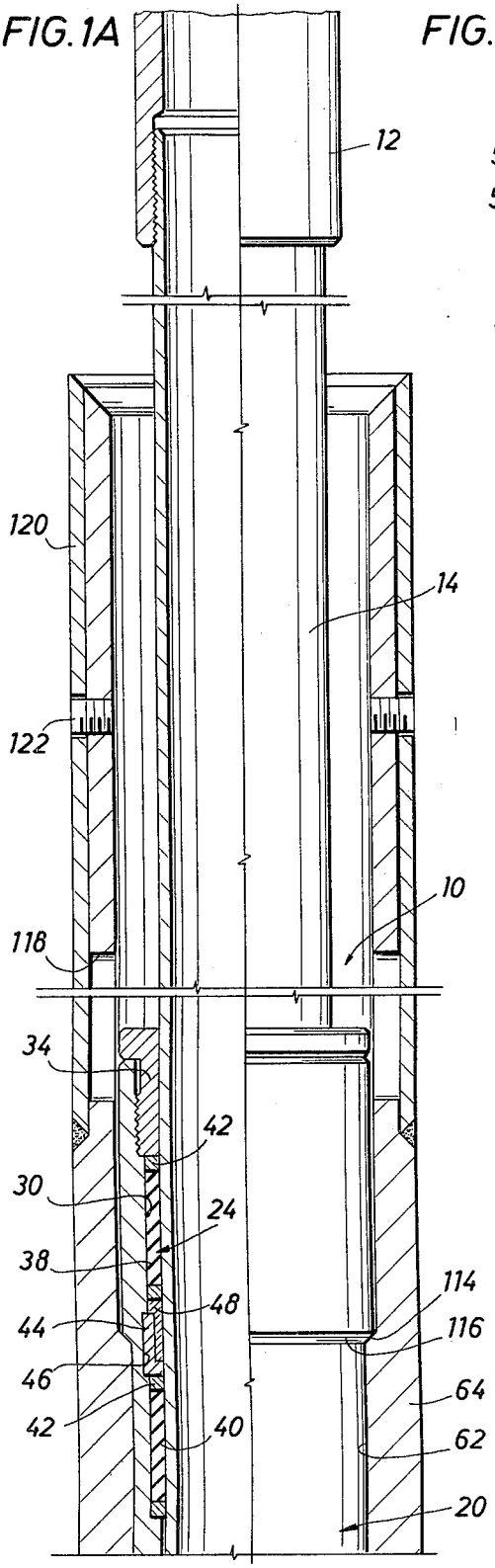
FIGS. 1A and 1B combined provide an elevation in partial section of a seal assembly mounted on a pipe string in running in configuration and positioned within a segment of a well conduit according to the present invention, FIG. 1A showing the top portion of the apparatus and FIG. 1B showing the bottom portion.
Figure 1B:
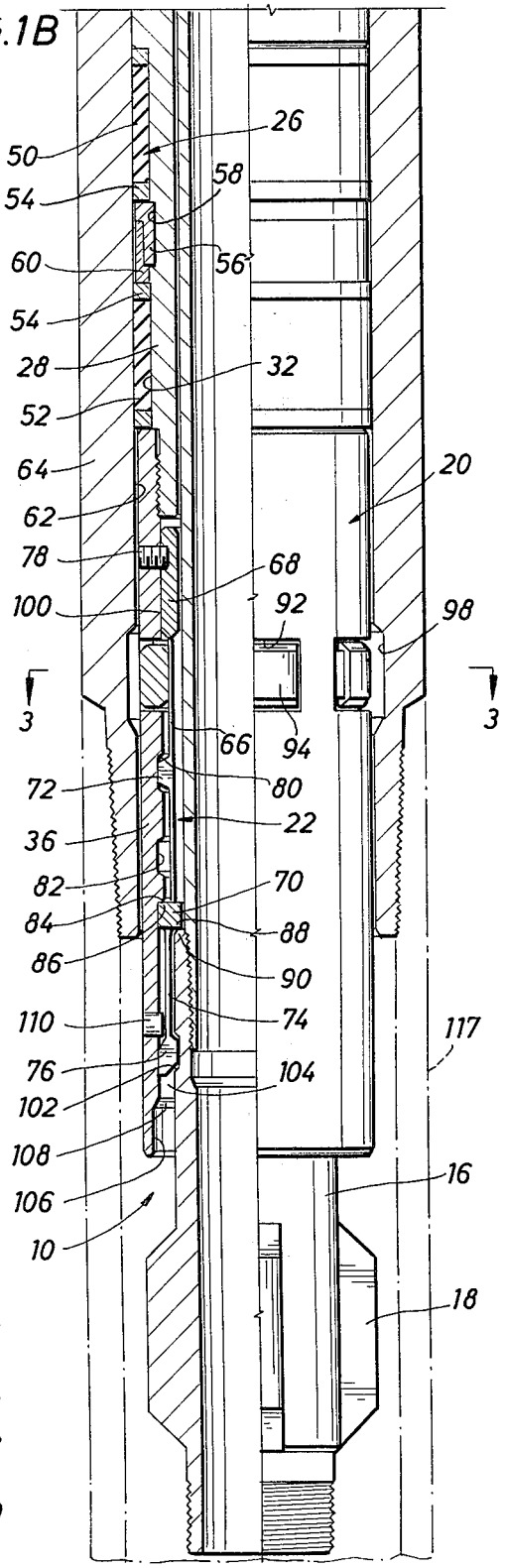

A well packer or seal apparatus according to the present invention is shown generally at 10 in FIGS. 1A and 1B combined, in running in configuration supported by a pipe string 12. The pipe string includes a pipe segment in the form of a polished nipple 14. A sub 16 is threadedly engaged to the bottom of the nipple 14 and carries an assembly of centralizers 18 for guiding the pipe string 12.

The seal assembly 10 includes a first, or outer, annular member shown generally at 20 and a second, or inner, annular member shown generally at 22.

The first member 20 carries a first, or interior, annular sealing assembly shown generally at 24, and a second, or exterior, annular sealing assembly shown generally at 26. The first member 20 further includes an annular seal body 28 having an interior, elongate annular recess 30 opening toward the top of the seal body, and an external, elongate annular recess 32 opening toward the bottom of the seal body. The interior sealing assembly 24 is mounted on the seal body 28 within the interior recess 30 and held in place by a retainer ring 34 threaded to the top end of the seal body. The exterior sealing assembly 26 is mounted on the seal body 28 within the exterior recess 32 and held in place by a latch body 36 threaded to the bottom end of the seal body.

The interior sealing assembly 24 is construced to provide sliding, sealing engagement between the seal body 28 and the polished exterior surface of the nipple 14. Two arrays of resilient, annular seal members 38 and 40 are buttressed at their respective longitudinal ends by packing headers 42, and further separated by a two-part, split ring 44. Each of the semi-circular ring halves has a L-shaped cross section, and lies within an appropriate annular grooves 46 within the recess 30. A cover ring 48 having a complementary L-shaped cross section overlies and maintains in position the split ring 44. The positioning, size and construction of the elements included in the interior sealing assembly 24 are such that, with the retainer ring 34 threaded in place, the arrays of seal members 38 and 40 extend sufficiently radially to be compressed between the surface of the seal body 28 within the recess 30 and the exterior surface of the polished nipple 14 to provide a slidable, fluid-tight seal between the first member 20 and the nipple. The seal members of the arrays 38 and 40 may be chevron-type seal elements, for example, or any type seal elements capable of providing the sliding, sealing engagement described.

The construction and arrangement of the exterior sealing assembly 26 are similar to those of the interior sealing assembly 24. Two arrays 50 and 52 of resilient, annular seal members, buttressed by packing headers 54, are separated by an assembly including a two-part split ring 56 of L-shaped cross section maintained within an annular groove 58 by a cover ring 60 of complementary L-shaped cross section, with the seal elements of the arrays 50 and 52 maintained, with the aid of the latch body 36, to provide a slidable, fluid-tight seal between the surface of the seal body 28 within the recess 32 and a polished seating surface 62 on the interior of a circumscribing well conduit segment 64.

The second seal apparatus member 22 is constructed in the form of a collet assembly. A plurality of longitudinally oriented collet ribs 66 extend between a top base collar 68 and a lower ring 70. Midway its length, each rib 66 carries a radially outwardly extending protrusion 72, beveled at its upper and lower limits, to serve as a latch dog. A plurality of collet fingers 74 extends downwardly from the ring 70. Each collet finger 74 ends in an enlarged portion 76, extend radially inwardly and outwardly, generally beveled at its upper and lower extremities as shown in FIG. 1B, and serving also as a latch dog. It will be appreciated that the latch dogs 72 and 76 are generally movable radially inwardly and outwardly with the deformation and relaxation of the collet ribs 66 and collet fingers 74, respectively. In the disposition illustrated in FIG. 1B, the collet ribs 66 and collet finbers 74 may be in their respective relaxed states.

The latch body 36 generally encloses the second member 22, and, in the running in configuration of FIGS. 1A–1B, is locked to the second member by one or more shear screws or pins 78. The shear screws 78 serve as a frangible mechanism for maintaining the relative longitudinal positions of the first and second members 20 and 22, respectively, until the members are to be selectively moved to another configuration, as described in further detail hereinafter.

The interior surface of the latch body 36 is broken by first and second annular grooves or profiles 80 and 82, respectively, mutually axially displaced to receive the latch dogs 72. The dogs 72 reside in the first profile 80 with the second member positioned relative to the latch body as illustrated in FIG. 1B, and reside in the second profile 82 with the second member in a second configuration (FIG. 2) as described hereinafter. Both of the latch body grooves 80 and 82 have beveled sides to facilitate movement of the beveled latch dogs 72 into and out of the profiles as selected.

Below the second profile 82 the interior surface of the latch body 36 features a downwardly-facing, annular shoulder 84 which, in the running in configuration of FIG. 1B, abuts the upper exterior annular edge 86 of the collet ring 70. The lower interior annular edge 88 of the collet ring 70 is, in the configuration of FIG. 1B, in abutment with the top annular surface 90 of the centralized sub 16.

Figure 3:
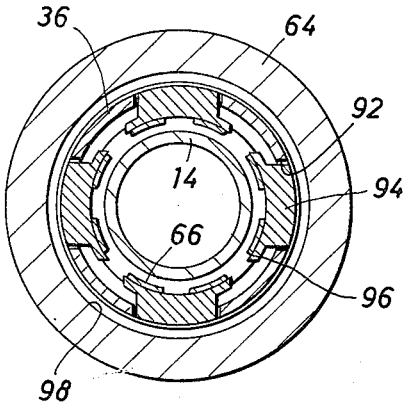
FIG. 3 is a horizontal cross section taken along line 3—3 of FIG. 1B illustrating the latching dogs used to engage the well conduit, with the dogs in release configuration.
Figure 5:
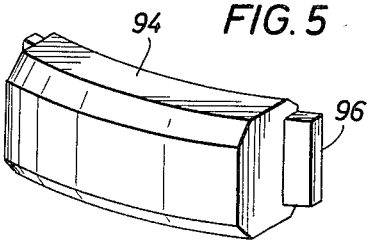
FIG. 5 is a perspective view of the latching dogs of FIGS. 3 and 4.

The latch body is further broken by four apertures 92 symmetrically positioned about the circumference of the latch body. A latching dog 94 is mounted for radial movement within each of the apertures 92. As shown in FIG. 5, each of the four latch dogs 94 has beveled arcuate edges and a circumferentially extending flange 96 protruding from each end of the dog at the radial inner extent of the dog. The four latch dogs 94 are mounted within the symmetrically spaced apertures 92 with the flanges 96 overlapping the circumferential peripheries of the apertures to prevent the latch dogs from falling radially outwardly from the latch body 36. The disposition of the latch bodies 94 in the running in configuration of FIG. 1B may be further appreciated by reference to FIG. 3. The interior surface 62 of the well conduit 64 is broken by an annular groove or profile 98 for receiving the latch dogs 94. In the configuration of FIG. 1B the collet ribs 66 between the base collar 68 and the rib-mounted latch dogs 72 are positioned radially within the locations of the latch dogs 94. The radial extension of the ribs 66 in the instant configuration is insufficient to force the latch dogs 94 radially beyond the outer surface of the latch body 36. Consequently, in the configuration of FIG. 1B with the collet ribs 66 in registration with the latch dogs 94, the later are not propelled into the conduit profile 98.

Figure 2:
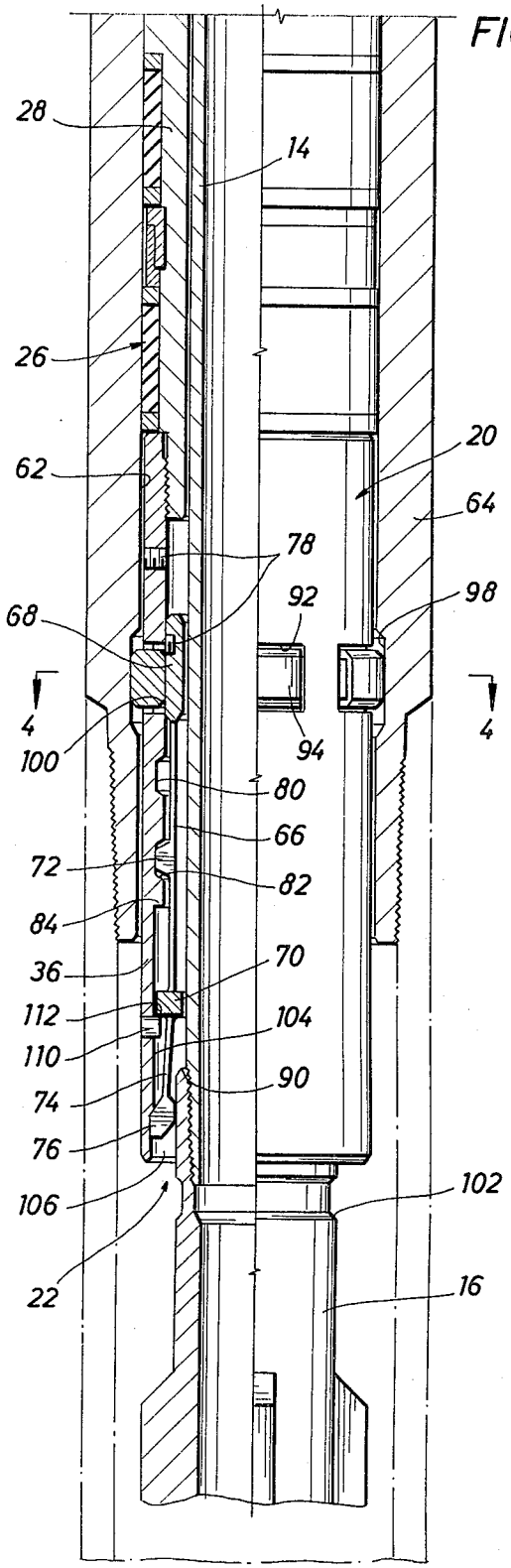
FIG. 2 is a view similar to FIG. 1B and illustrating the lower portion of the seal assembly latched to the well conduit and released from latching engagement with the pipe string.
Figure 4:
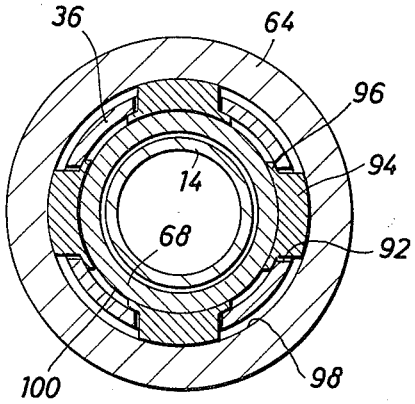
FIG. 4 is a horizontal cross section taken along line 4—4 of FIG. 2 showing the dogs of FIG. 3 in latching engagement with the well conduit.

The outer annular surface 100 of the base collar 68 is of greater diameter than the radial extension of the collet ribs 66 in the configuration of FIG. 1B. In the configuration illustrated in FIGS. 2 and 4 are discussed in detail hereinafter, the base collar 68 is in registration with the latch body dogs 94 so that the collar outer surface 100 forces the dogs 94 to protrude radially outwardly through the apertures 92 and into the conduit profile 98, the outward radial movement by the dogs 94 being limited by engagement of the flanges 96 with the inner surface of the latch body 36 as noted hereinbefore (FIG. 4). Beveling of the sides of the conduit groove 98 faciliates the movement of the beveled latch body dogs 94 into and out of the profile in the operation further described hereinafter.

Aobve the centralizers 18 the sub 16 features on its outer surface a beveled, annular groove or profile 102 for receiving the latch dogs 76 mounted on the collet fingers 74. The interior surface of the latch body 36 is further structured to manipulate the latch dogs 76. The latch body interior surface 104 toward the bottom of the latch body 36 is of sufficiently small interior diameter that the surface 104, when in registration with the latch dogs 76, maintains the latch dogs residing within the sub groove 102 as shown in FIG. 1B. An annular interior surface segment 106 of the latch body 36, extending below the lower limit of the surface 104 and connected thereto by a frustoconical, downwardly-facing surface bevel 108, is of sufficiently large internal diameter to permit the latch dogs 76 to be moved radially outwardly out of the sub groove 102, as illustrated in FIG. 2, for example, The beveled surface of the groove 102 facilitates movement of the latch dogs 76 into and out of the groove. In the configuration of FIG. 2, the beveled latch body surface 108 may receive the top bevel of the outer surface of the latch dog 76, with the larger interior diameter surface 106 accommodating the radial depth of the latch dogs as shown.

One or more lugs 110 are carried by the latch body 36, mounted in appropriate apertures through the wall of the latch body and extending radially inwardly beyond the inner surface of the latch body. In the configuration of FIG. 2, the lugs 110 abut the lower exterior annular edge 112 of the collet ring 70 as a stop against further longitudinal movement of the second member 22 downwardly relative to the first member 20. During assembly of the apparatus, the lugs 110 may be fixed in place relative to the latch body 36 after the second member 22 is positioned within the latch body.

The interior seating surface 62 of the well conduit 64 is defined at the upper end of the seating surface by an upwardly-facing, frustoconical shoulder 114 acting as a stop, or detent, to limit the downward longitudinal movement of the first member 20 of seal assembly 10 by engaging a generally complementary, downwardly-facing, frustoconical shoulder 116 included as part of the seal body 28.

The well conduit 64 may be provided by any type of tubing previously positioned within a well in which the seal assembly 10 is to be utilized. A profile, such as the groove 98, for receiving the latching dogs 94, and a detent, such as the shoulder 114, with a seating surface such as 62 positioned between the detent and profile are all that is required of the well conduit to receive and be sealed by the seal assembly 10. As illustrated, the well conduit 64 may be included in a well liner assembly, which may extend downwardly from the conduit 64 as indicated in phantom by the liner segment 117. If such is the case, for example, the conduit 64 may be located at or near the top of the liner assembly cemented in place in the well. For example, the conduit 64 may extend upwardly to include a Jay-slot 118, and may be backed by a tie-back sleeve 120 welded to the exterior of the conduit to cover the Jay-slot. The liner assembly including the conduit 64 may have been previously positioned within the well for cementing purposes by a pipe string connected to the assembly by means of a pair of Jay-pins (not shown) residing in the Jay-slots 118, and fixed to the tie-back sleeve 20 and conduit 64 by a pair of shear screws 122. In the operation of setting the liner assembly in the well, the shear screws 122 are broken to accommodate manipulation of the pipe string relative to the liner assembly and the Jay-slots 118 to set a liner hanger, for example. Regardless of the nature of the well conduit to which the seal assembly 10 is to be engaged, the detent (shoulder 114) and profile (groove 98) may be provided as illustrated, or in any other suitable manner such as by tubular member end surfaces joined at collar joints, for example. The application of the well seal assembly as illustrated is not limited to the nature of the well conduit.

To utilize the seal assembly 10 to provide a seal between a pipe string 12 and a well conduit 64, the seal assembly is mounted on the polished nipple 14 in the first configuration illustrated in FIGS. 1A and 1B. The interior sealing assembly 24 sealingly engages the outer seating surface of the polished nipple 14. The second member 22 is positioned within the first member 20 with the collet dogs 72 mounted on the collet ribs 66 received within the first latch body profile 80. In this first configuration of the first and second members the base collar 68 of the second member 22 is axially disposed from the latch body dogs 94, and the latch dogs 76 positioned at the ends of the collet fingers 74 are within the latch body surface 104. The collet-finger mounted dogs 76 are thus maintained within the centralizer sub groove 102, latching the seal assembly 10 to the sub and the pipe string nipple 14. The shear pins 78 connect the first and second members 20 and 22, respectively, to maintain this first configuration.

As the pipe string 12 is made up at the surface, the sub 16 and the polished nipple 14, with the seal assembly 10 mounted thereon in releasable engagement by means of the latch dogs 76 and sealed to the nipple by the interior sealing assembly 24, are lowered within the well conduit until the seal assembly shoulder 116 engages the shoulder 114 on the well conduit segment 64. Further downward movement of the first seal assembly member 20 is thus prevented. If the pipe string 12 is moved longitudinally downwardly within the conduit 64 with the shoulders 114 and 116 in abutting engagement, the shear screws 78 must be broken to permit the second member 22, which is held to the sub 16 by the latch dogs 76, to move with the pipe string. However, the shear screws 78 may be of sufficient shear strength that the well operator may detect the engagement of the shoulders 114 and 116 without breaking the shear screws. The operator may then raise the pipe string to measure a pipe string stroke to be utilized in further operations on the well, for example.

To set the seal assembly 10 within the well conduit 64, the operator lowers the pipe string 12 to engage the shoulders 114 and 116. At that point, the exterior sealing assembly 26 is within the longitudinal extent of the well conduit polished interior surface 62 to seal the seal assembly 10 to the conduit 64. Also, the latch body dogs 94 are in registration with the well conduit profile 98. Then, further movement of the pipe string 12 downwardly relative to the well conduit 64 will pull the second member 22 downwardly relative to the first member 20, breaking the shear screws 78 and causing the collet-rib mounted latch dogs 72 to ride out of the first latch body profile 80. The radially inward movement of the latch dogs 72 required to move the dogs out of the groove 80 causes the collet ribs 66 to flex radially inwardly, the relative diameters of the components including the outer surface of the nipple 14 accommodating such radial flexing.

The downward movement of the second member 22 with the pipe string 12 continues until the latch dogs 76, residing in the groove 102, are pulled downwardly beyond the lower limit of the latch body interior surface 104. The latch dogs 76 are then in registration with the larger internal diameter latch body surface 106 and the beveled surface 108, and may move out of the sub profile 102 as illustrated in FIG. 2. The collet-rib mounted latch dogs 72 are placed in registration with, and moved into, the second, lower profile 82 of the latch body 86. The action of the collet ribs 66 drives the latch dogs 72 into the second profile 82 and maintains them in the profile to releasably latch the seal assembly 10 in the second configuration of FIG. 2. Also, the lower outer edge 112 of the collet ring 70 is in abutting engagement with the lugs 110.

As the second body 22 is moved to the second configuration illustrated in FIG. 2, the collet base collar 68 is drawn downwardly into registration with the latch body dogs 94, the lower beveled surface of the collar and the upper interior beveled surface of the dogs 94 facilitating such movement. The exterior surface 100 of the collar 68 thus engages the interior surfaces of the dogs 94, moving the dogs radially outwardly into the well conduit profile 98 and maintaining the dogs therein in latching engagement with the well conduit 64.

The manipulation of the seal assembly 10 from the first configuration of FIGS. 1A and 1B to the second configuration of FIG. 2 is accomplished by the downward movement of the pipe string 12 relative to the well conduit 64. In that operation, the seal assembly 10 is released from latching engagement with the pipe string 12 as the collet latch dogs 76 are permitted to move radially outwardly relative to the sub profile 102, and the seal assembly is releasably latched to the well conduit 64 as the latch body dogs 94 are forced into the well conduit profile 98. Furthermore, the first and second seal assembly members 20 and 22, respectively, are releasably latched in the second configuration by the collet latch dogs 72 being maintained within the second latch body profile 82 by the collet ribs 66 maintaining the relaxed state. Additionally, the second body 22 is prevented from further downward movement relative to the first body 20 from the second configuration of FIG. 2 by the engagement of the collet ring edge 112 with the lugs 110.

During the entire setting operation, the seal assembly 10 maintaines sealing engagement with both the pipe string 12, by means of the interior sealing mechanism 24, and the well conduit 64, by means of the exterior sealing mechanism 26. Furthermore, with the pipe string 12 released from latching engagement with the seal assembly 10, the pipe string may be moved, to the extent of the polished nipple 14, longitudinally downwardly and, to a limited extent, upwardly relative to the seal assembly and the well conduit 64 to which the seal assembly is fixed. Such movement by the pipe string 12 maintains the sealing engagement between the seal assembly 10 and the pipe string as long as the polished exterior seating surface of the landing nipple 14 is in engagement with the interior sealing assembly 24. Additionally, the sealing engagement effected between the sealing mechanism 24 and the polished nipple 14, as well as the sealing engagement effected between the exterior sealing assembly 26 and the polished surface 62 of the well conduit 64, is maintained in the presence of sliding between the seal assembly and the respective surfaces. The ability of the collet fingers 74 to be deformed accommodates the latch dogs 76 riding over the exterior surface of the sub 16 as shown in FIG. 2. The beveling of the interior surfaces of the dogs 76 and that of the sub exterior surface facilitates movement of the dogs 76 over the top end of the sub as well as in and out of the profile 102. Consequently, the pipe string 12 may be manipulated longitudinally relative to the well conduit 64 to carry out various well working operations, for example, while maintaining the pipe string sealed to the well conduit. Additionally, thermal expansion of the pipe string 12, accompanied by downward movement of the nipple 14 relative to the seal assembly 10 anchored to the well conduit 64, will not interfere with the integrity of the sealing between the pipe string and the well conduit as provided by the seal assembly.

The seal assembly 10 may be released from anchoring engagement with the well coduit 64 and releasably latched to the pipe string 12 by sufficient upward movement of the pipe string relative to the well conduit. As the pipe string 12 is raised, the sub profile 102 is brought into registration with the collet latch dogs 76, still residing in registration with the large-diameter latch body surface 106. The latch dogs 76 are thus permitted to move within the groove 102 upon relaxation of the collet fingers 74. The top surface 90 of the centralizer sub 16 is brought into abutting engagement with the collet ring surface 88 (FIG. 1B), so that further upward movement by the pipe string 12 drives the collet ring 70 and, therefore, the second member 22 upwardly relative to the well conduit 64. The first member 20 remains longitudinally fixed relative to the conduit 64 as long as the latch body dogs 94 are maintained within the conduit profile 98 by the collet base collar surface 100. With the upward movement of the second member 22 relative to the first member 20, the collet latch dogs 72 are forced out of the second latch body profile 82, again flexing the collet ribs 66 radially inwardly. The sub 16 continues to move the second body 22 upwardly relative to the well conduit 64, driving the base collar 68 upwardly relative to the latch body dogs 94. When the second member 22 has been moved to bring the collet latch dogs 72 into registration with the first latch body profile 80, the collet ribs 66 move the dogs 72 into the profile 80 and maintain the dogs therein to latch the first and second members 20 and 22, respectively, in the first configuration of FIGS. 1A and 1B. The outer surface 100 of the base collar 68 is clear of the latch body dogs 94 in that configuration, and the dogs 94 are permitted to move radially inwardly, being in registration with the collet ribs 66 of lesser outer diameter than the collar surface 100.

As the second member 22 is moved into the first configuration of FIGS. 1A and 1B relative to the first member 20, the collet latch dogs 76 are moved into registration with the smaller internal diameter latch body surface 104, which maintains the latch dogs 76 in the sub profile 102 in releasable latching engagement with the pipe string 12. The seal assembly 10 is thus released from anchoring engagement with the conduit 64, and is anchored to the pipe string 12.

With the seal assembly 10 in the first configuration of FIGS. 1A and 1B, the collet ring edge 86 abuts the latch body shoulders 84 to prevent further upward movement of the second member 22 relative to the first member 20. Consequently, further upward movement of the pipe string 12, to which the second member 22 is releasably anchored by the latch dogs 76 being held in the sub profile 102, raises both the second member and the first member 20, the two members being releasably latched together also by the latch dogs 72 being maintained by the collet ribs 66 in the first latch body profile 80. The seal assembly 10 may then be moved longitudinally relative to the well conduit 64, and may be retrieved from the well with the pipe string 12. Alternatively, the seal assembly may be again lowered on the pipe string 12 to be set in sealing and anchoring engagement with the well conduit 64, the setting and releasing operations being carried out an indefinite number of times as selected.

The present invention has a wide range of applications. Further, the seal assembly construction of the present invention is relatively inexpensive to accomplish, particularly when compared with conventional packers. Additionally, the construction and operation of the seal assembly may be varied to accommodate the application, or for convenience. For example, any number of latching dogs may be utilized to releasably anchor the seal assembly in the different configurations, and to the pipe string and the well conduit. The construction of the dogs, and their manner of anchoring or gripping may also be varied.

Among the many applications of the present invention is the use of a seal assembly so constructed and operated as a production packer, for example. The well conduit to which the seal assembly is anchored and sealed in the well may be lining or casing cemented in place. The pipe string used to position and operate the seal assembly may be a production pipe string so that, once the seal assembly is located within and anchored and sealed to the well conduit, the same pipe string may be retained in the well and used to accommodate fluid flow to the surface.

The foregoing disclosure and description of the invention is illustrative and explanatory thereof, and various changes in the method steps as well as in the details of the illustrated apparatus may be made within the scope of the appended claims without departing from the spirit of the invention.

We claim:

1. A bottom lock pipe seal assembly comprising:

a. a first latch mechanism selectively operable for releasably latching said seal assembly to a pipe string generally circumscribed by said seal assembly for manipulating said seal assembly within a well conduit;

b. second latch mechanism selectively operable for releasably anchoring said seal assembly to such conduit;

c. detent mechanism operable to maintain said seal assembly in a first configuration, in which said first latch mechanism is in anchoring configuration, and in a second configuration in which said second latch mechanism is in anchoring configuration, the operation of said first and second latch mechanisms being interconnected so that when one of said latch mechanisms is in configuration to so anchor the seal assembly the other of said latch mechanisms is released from anchoring said seal assembly and at all times one or the other of said latch mechanisms is in anchoring configuration;

d. seal means carried by said seal assembly for sealingly engaging an exterior seating surface included in said pipe string, and for sealingly engaging an interior seating surface included in said conduit; and e. second detent mechanism for limiting longitudinal movement of said seal assembly along said well conduit;

f. whereby said seal assembly can be positioned within said conduit to effect operation of said second detent mechanism while said seal assembly is anchored on said pipe string, said seal assembly can thereafter be anchored to said well conduit by longitudinal movement of said pipe string, said pipe string is permitted at least limited longitudinal movement with said seal assembly anchored to said well conduit and sealing said well conduit to said pipe string, and said seal assembly can be released from anchoring to said well conduit and may be anchored to said pipe string by longitudinal movement of said pipe string.

2. A seal assembly, for sealing a pipe string to a well conduit, comprising:

a. first and second generally annular members circumscribing the pipe string within the well conduit, and mutually movable longitudinally between a first configuration and a second configuration;

b. first latch means, carried by said second member and movable radially between a contracted configuration, in which said first latch means may be received within a profile carried by said pipe string, and an extended configuration in which said first latch means is radially beyond said pipe string profile;

c. first surface means included in said first member for cooperating with said first latch means for selectively maintaining said first latch means within said pipe string profile when said first and second members are in said first configuration, whereby said first and second members are releasably latched to said pipe string, and such that said first surface means permits said first latch means to move to said extended configuration when said first and second members are in said second configuration, whereby said first and second members are not latched to said pipe string;

d. second latch means carried by said first member and movable radially between an extended configuration, in which said second latch means may be received within a profile carried by said conduit, and a retracted configuration in which said second latch means are not within said conduit profile;

e. second surface means included in said second member for selectively maintaining said second latch means in said extended configuration within said conduit profile when said first and second members are in said second configuration, whereby said first and second members are releasably latched to said conduit, and such that said second surface means permits said second latch means to move to said retracted configuration when said first and second members are in said first configuration, whereby said first and second members are not latched to said conduit;

f. third latch means for selectively maintaining said first and second members in said first and second configurations;

g. a first annular resilient seal assembly carried by said first member for sealingly engaging said pipe string, and a second annular resilient seal assembly carried by said first member for sealingly engaging said conduit, said first and second members being selectively movable between said first and second configurations by operation of said pipe string moving said second member longitudinally relative to said first member while said first member is constrained against longitudinal movement in one direction by said conduit; and wherein said pipe string includes an exterior annular seating surface with which said first seal assembly may sealingly engage, and such that, with said first and second members latched to said conduit in said second configuration, said first seal assembly can maintain sealing engagement with said pipe string seating surface as said pipe string is moved longitudinally relative to said first seal assembly.

3. A seal assembly as defined in claim 2, wherein:

a. said first latch means comprises a plurality of dogs carried by said second member for radial movement;

b. said first surface means comprises an interior annular surface of said first member and of such internal diameter that, when said annular surface is in registration with said latch dogs, said annular surface maintains said latch dogs in said radially contracted configuration; and c. said annular surface of said first member is in registration with said latch dogs when said first and second members are in said first configuration, and said annular surface of said first member is not in registration with said latch dogs when said first and second members are in said second configuration, whereby said latch dogs may be permitted to move into said radially extended configuration.

4. A seal assembly as defined in claim 3 wherein:

a. said second latch means comprises a plurality of latch dogs mounted for radial movement within a like number of apertures in said first member;

b. said second surface means comprises a first exterior annular surface of said second member, which first annular surface, when in registration with said latch dogs, maintains said latch dogs in said radially extended configuration, and a second exterior annular surface of said second member of lesser diameter than said first annular surface, which second annular surface, when in registration with said latch dogs, permits said latch dogs to move to said radially retracted configuration; and c. said first annular surface is in registration with said latch dogs when said first and second members are in said second configuration, and said second annular surface is in registration with said latch dogs when said first and second members are in said first configuration.

5. A seal assembly as defined in claim 4 wherein said second exterior annular surface of said second member comprises the exterior surfaces of an array of collet ribs included in said second member.

6. A seal assembly as defined in claim 5 wherein said third latch means comprises first and second mutually longitudinally displaced profiles included in one of said first and second members, and latch dogs carried by the other of said members radially biased toward said first and second profiles such that, when said first and second members are in said first configuration, said latch dogs are in said first profile and, when said first and second members are in said second configuration, said latch dogs are in said second profile, and wherein said latch dogs are resiliently mounted to permit selective withdrawal of said latch dogs from said first and second profiles for movement of said first and second members between said first and second configurations.

* * * * *